US011773533B2

(12) United States Patent
Bianco et al.

(10) Patent No.: US 11,773,533 B2
(45) Date of Patent: Oct. 3, 2023

(54) COMPOSITION FOR USE IN THE FINISHING, PRESERVATION, RESTORATION OF MANUFACTURES

(71) Applicant: UNIVERSITÀ DEGLI STUDI DI ROMA "LA SAPIENZA", Rome (IT)

(72) Inventors: Armandodoriano Bianco, Rome (IT); Ilaria Serafini, Rome (IT); Giuseppe Cavallaro, Palermo (IT); Giuseppe Lazzara, Palermo (IT)

(73) Assignee: UNIVERSITÀ DEGLI STUDI DI ROMA "LA SAPIENZA", Rome (IT)

( * ) Notice: Subject to any disclaimer, the term of this patent is extended or adjusted under 35 U.S.C. 154(b) by 526 days.

(21) Appl. No.: 16/769,875

(22) PCT Filed: Nov. 23, 2018

(86) PCT No.: PCT/EP2018/082336
§ 371 (c)(1),
(2) Date: Jun. 4, 2020

(87) PCT Pub. No.: WO2019/110325
PCT Pub. Date: Jun. 13, 2019

(65) Prior Publication Data

US 2021/0108362 A1 Apr. 15, 2021

(30) Foreign Application Priority Data

Dec. 5, 2017 (IT) ..... 102017000140041

(51) Int. Cl.
*D21H 23/66* (2006.01)
*D21H 25/02* (2006.01)
(Continued)

(52) U.S. Cl.
CPC ..... *D06M 15/03* (2013.01); *D06M 15/15* (2013.01); *D06M 23/00* (2013.01); *D21H 25/02* (2013.01); *D21H 25/18* (2013.01)

(58) Field of Classification Search
CPC ..... D06M 15/03; D21H 25/18; D21H 25/02
See application file for complete search history.

(56) References Cited

U.S. PATENT DOCUMENTS

2011/0305765 A1* 12/2011 Mathur ..... A61K 47/36 977/773
2015/0010630 A1* 1/2015 Llamas ..... A61L 27/3604 424/278.1

(Continued)

FOREIGN PATENT DOCUMENTS

CN 101619540 A 1/2010
CN 102002854 A 4/2011

(Continued)

OTHER PUBLICATIONS

Ciolacu et al. Chitosan Derivatives as Bio-based Materials for Paper Heritage Conservation. BioResources. vol. 12, No. 1. 2017 (Year: 2017).*

(Continued)

*Primary Examiner* — Cachet I Proctor
(74) *Attorney, Agent, or Firm* — Volpe Koenig

(57) ABSTRACT

An aqueous composition comprising chitosan and fibroin nanoparticles, with a diameter equal or lower than 140 nm, and an acid agent, with pH equal or lower than 6, and viscosity equal or lower than 3.5 $kg \times m^{-1} \times s^{-1}$ measured at 25.0±0.1° C., kit and method for finishing and/or preservation and/or restoration and/or renovation and/or repairing and/or consolidation of manufactures, in particular ancient manufactures are disclosed.

15 Claims, 4 Drawing Sheets

(51) Int. Cl.

| | |
|---|---|
| ***D06M 15/03*** | (2006.01) |
| ***D06M 15/15*** | (2006.01) |
| ***D06M 23/00*** | (2006.01) |
| ***D21H 25/18*** | (2006.01) |

(56) References Cited

U.S. PATENT DOCUMENTS

| | | | | |
|---|---|---|---|---|
| 2019/0247514 | A1* | 8/2019 | Bozkurt | A61K 9/0014 |
| 2021/0108362 | A1* | 4/2021 | Bianco | D06M 15/15 |

FOREIGN PATENT DOCUMENTS

| | | | | | |
|---|---|---|---|---|---|
| CN | 103436985 | A | * | 12/2013 | |
| CN | 103436985 | A | | 12/2013 | |
| CN | 103668993 | A | | 3/2014 | |
| CN | 104027300 | A | | 9/2014 | |
| CN | 105497913 | A | | 4/2016 | |
| DE | 10040564 | A1 | * | 2/2002 | D21H 25/18 |
| DE | 10040564 | A1 | | 2/2002 | |
| WO | WO-2008118133 | A2 | * | 10/2008 | A61K 31/7076 |
| WO | WO-2010059963 | A2 | * | 5/2010 | A61K 47/36 |

OTHER PUBLICATIONS

Zhou et al. Electrospinning of carboxyethyl chitosan/poly(vinyl alcohol)/silk fibroin nanoparticles for wound dressings. Int J Biol Macromol. Feb. 2013;53:88-92. doi: 10.1016/j.ijbiomac.2012.11.013. Epub Nov. 16, 2012. (Year: 2013).*

Database WPI, Week 201013, Jan. 6, 2010 (Jan. 6, 2010) Thomson Scientific. London. GB; AN 2010-A77950; XP002783485; also CN 101 619 540 A.

Wu S.-Q. et al., Carbohydrate Polymers, 88: 496-501, 2012.

Howell D. et al Journal of Materials Science, 42: 5452-5457, 2007.

Kerr N. et al., Historic Textile & Paper Matls. II (ACS Symp. Ser. No.410) /Symp. 196th ACS Mtg. (Los Angeles, Sep. 25-30, 1988) Chap. 10: 25-30, 1989.

Verdu J. et al., Studies in Conservation, 29( sup 1): 64-69, 1984.; Hillyer L. et al., The Conservator, 21(1): 37-47, 1997.

Ragauskienē D.et al., Chemija, 17-2,3: 52-59, 2006.

Thomspon J.et al., Paper presented at the CCI Adhesives and Consolidants for Conservation Research and Applications Symposium 2011, Ottawa, ON, Canada, 2011.

Huang D.et al., Reactive & Functional Polymers, 73:168-174, 2013.

Zhu Z. et al., Heritage Science, 1:13. 2013.

Zhou Y. et al., Sciences of Conservation and Archaeology, 22 (3): 44-48, 2010; Scheda Tecnica glutaraldeide, Azienda Ospedaliera di Bologna "Policlinico S. Orsola—Malpighi".

Feng Z. et al., Proceedings of Symposium 2011—Adhesive and Consolidants for Conservation—Research and application, 2011.

Dutta P. K. et al., Journal of Scientific & Industrial Research, 63: 20-31, 2004.

Kumar M. V. N. R., Reactive & Functional Polymers, 46: 1-27, 2000.

Conti, S.et al., Paper presented at the CCI Adhesives and Consolidants for Conservation Research and Applications Symposium 2011, Ottawa, ON, Canada, 2011.

Shiah, T.-C. et al., Taiwan Journal of Forest Science, 24 (4): 285-294, 2009.

Ardelean, E. et al., European Journal of Science and Theology, 5 (4): 67-75, 2009.

Kata S. et al., ANAGPIC 2013—Student Papers and Posters, Presented at the 2013 Annual Student Conference hosted by the UCLA/Getty Program in Archaeological and Ethnographic Conservation, 2013.

Zhang Y. Q., et al., Journal of Nanoparticle Research, 9:885-900, 2007.

* cited by examiner

COMPOSITION FOR USE IN THE FINISHING, PRESERVATION, RESTORATION OF MANUFACTURES

BACKGROUND OF THE INVENTION

The present invention refers to the field of chemistry and more in particular to the field of preservation and restoration of manufactures, more particularly antique manufactures, since it concerns a composition to be applied in order to preserve and restore textiles and paper, preferably ancient textiles and paper.

STATE OF THE ART

Historical textiles, representing one of the most important parts of cultural and artistic heritage, comprise a large variety of artworks: tapestries, clothing, textile coatings, etc. Historical textiles are fragile because of their use. In fact, clothes arose as functional objects, and then naturally intended to be used and wear; tapestries were exposed in the rooms, often vertical, and then subjected to mechanical stress. Furthermore, exposition to light, water, microorganisms and heat, led to chemical and photochemical stresses, resulting in the alteration of fabrics and dyes employed (Wu S.-Q. et al., Carbohydrate Polymers, 88: 496-501, 2012).

For what concerns the restoration of textile manufactures, several procedures have been followed during the last decades. In addition to usual activities of cleaning, performed with different protocols and different nonionic- or anionic-surfactants (Howell D. et al Journal of Materials Science, 42: 5452-5457, 2007), deacidification, especially for cellulosic textiles (Kerr N. ET AL., Historic Textile & Paper Matls. II (ACS Symp. Ser. No.410)/Symp. 196th ACS Mtg. (Los Angeles, 25-30 Sep. 1988) Chap. 10: 25-30, 1989), employment of fungicides, the use of adhesive and consolidation polymers, generally synthetics, is widespread. In many cases, the restorers are moved to use adhesives, especially for supporting of fragile textiles, as the archaeological ones, which are subjected to pulverization and heavy decay (Verdu J. et al., Studies in Conservation, 29(sup 1): 64-69, 1984.; Hillyer L. ET AL., The Conservator, 21(1): 37-47, 1997). In this case, conservators fix the archaeological materials on crepeline or other support, as linen fabrics, to avoid the loss of materials, during the transport or other restoration activities.

Several classes of synthetic polymers have been employed for conservative purpose. The main ones have been hydroxypropyl cellulose, known as Klugel, carboxymethyl cellulose, ethyl cellulose, Parylene-C (a vapor-polymerized coating, composed by polychloro-p-xylylene), poly-2-ehtyloxazoline (Aquazol®), polyacrylates and polivinylacetate (The Conservator, 21 (1):12-20, 1997).

In order to improve the ageing behavior of adhesive film, vinyl acetate in an adhesive copolymer was replaced with vinyl neodecanoate (Ragauskiene D. et al., Chemija, 17-2,3: 52-59, 2006). The direct use of adhesive is also considered an effective option (Thomspon J. et al., Paper presented at the CCI Adhesives and Consolidants for Conservation Research and Applications Symposium 2011, Ottawa, ON, Canada, 2011). Albeit polymers could have ensured good mechanical properties and high bonding capabilities, they resulted strongly invasive. They were strongly bounded to the textiles, promoting harm for the artworks, such as stiffness, yellowing and color differences, due to the aging behavior (Huang D. et al., Reactive & Functional Polymers, 73:168-174, 2013).

Furthermore, the deterioration of the synthetic polymers led to greater difficulty in removing themselves. In many cases, in order to remove the polymer that is deteriorated, yellowed and stiff, it has been necessary to apply a series of organic solvents or work under extreme conditions, including high temperature, which are extremely harmful to the textile (Wu S.-Q. et al., Carbohydrate Polymers, 88: 496-501, 2012).

Consolidation protocols using compatible materials were disclosed in the art (Zhu Z. ET AL. Heritage Science, 1:13. 2013).

The reinforcement of historical silk with a bacterial cellulose film has been proposed by Wu S.-Q. (Wu S.-Q. et al., Carbohydrate Polymers, 88: 496-501, 2012). However, the use of bacteria imposes strict conditions in culture growth, which results in long time; furthermore, their incomplete removal, after the consolidation action, or the use of improper bacteria can bring further decay of silk (Huang D. et al., Reactive & Functional Polymers, 73:168-174, 2013).

The use of fibroin protein as consolidant for ancient silk has been proposed, based on the fact that fibroin protein is the main constituent of the silk. In this case, fibroin solution is mixed with glutaraldehyde. The results of this consolidation method are unsatisfactory, looking at ultimate tensile strength value reached; furthermore, glutaraldehyde is toxic compound solution (Zhou Y. et al., Sciences of Conservation and Archaeology, 22 (3): 44-48, 2010; Scheda Tecnica glutaraldeide, Azienda Ospedaliera di Bologna "Policlinico S. Orsola-Malpighi").

Fibroin alone cannot be used are consolidant agent because fibroin in not able to create any relevant bound or link with the fiber with should be consolidated. Otherwise, nanofibroin particles, object of the present invention, were never tested in preserving textile manufactures.

Another example of the inability of fibroin alone to interact with textiles is offered by the case study of Feng, in which a system composed by fibroin-ethylene glycol diglycidyl ether (EDGE) is evaluated (Feng Z. ET AL., Proceedings of Symposium 2011—Adhesive and Consolidants for Conservation—Research and application, 2011; Huang D. ET AL., Reactive & Functional Polymers, 73:168-174, 2013).

The use of such cross-linking agents, the EDGE, could led to a further damage for textiles. In fact, cross-linking agents often contain unsaturated double bonds or multiple functional groups, which can result in phenomena like corrosion or toxicity.

Chitosan is a de-acetylated derivate of chitin, a linear chain polysaccharide, present in the exoskeletons of crustaceans and insects, the cell walls of fungi, and other natural sources. Chemically, Chitosan can be defined as (1→4)-2-amino-2-deoxy-β-D-glucopyranose or as a copolymer of β-(1→4)-D-glucosamine and N-acetyl-D-glucosamine (Dutta P. K. et al., Journal of Scientific & Industrial Research, 63: 20-31, 2004; Kumar M. V. N. R., Reactive & Functional Polymers, 46: 1-27, 2000).

Chitosan is compatible with organic substrates, because of its polysaccharide nature and its amino and hydroxyl functional groups; however, it is not soluble in water but required slight acidic conditions (pH 5) and this is the reason why the chitosan alone does not fit with the purpose of conservation of textile or cellulosic manufactures. The acid conditions promote in fact the hydrolysis of cellulosic and amino bonds (Conti, S. ET AL., Paper presented at the CCI Adhesives and Consolidants for Conservation Research and Applications Symposium 2011, Ottawa, ON, Canada, 2011).

Nonetheless, chitosan were tested for conservation of paper manufactures, thanks to its Anti-microbial properties (Shiah, T.-C. ET AL., Taiwan Journal of Forest Science, 24 (4): 285-294, 2009). However, chitosan salts, such as acetate, butyrate, propionate salts, did not provide enough resistance to tensile stress (Ardelean, E. et al., European Journal of Science and Theology, 5 (4): 67-75, 2009).

Moreover, aging studies on chitosan treated samples evidenced how chitosan acetate increases the stiffness of yarns (Conti, S. et al., Paper presented at the CCI Adhesives and Consolidants for Conservation Research and Applications Symposium 2011, Ottawa, ON, Canada, 2011; Kata S. et al., ANAGPIC 2013—Student Papers and Posters, Presented at the 2013 Annual Student Conference hosted by the UCLA/Getty Program in Archaeological and Ethnographic Conservation, 2013). At least, it causes chromatic variations and make treated samples hydrophobic, and this is a negative aspects, because does not allow consolidated threads cannot be subjected to further humidification and flattening actions, which are considered essential requirements for their best conservation.

The combined use of chitosan and fibroin in fibers is known in the art. CN103668993 discloses a mixture of chitosan, liquid fibroin, polyurethane, silicon oils, lysozymes, PEG and PPG used as finishing agent with antifungal properties.

CN102002854 discloses a mixture of chitosan, liquid fibroin, Titanium dioxide cross-linking agents and acetic acid as finishing agent for industrial fabrics.

CN104027300 refers to an antibacterial in-alcohol solution of chitosan and fibroin.

CN103436985 discloses a method for the preparation of fibroin-chitosan nano fibers.

CN105497913 refers to biological tissues made of nanofibers of fibroin, chitosan and nucleic acid.

US2011305765 describes nanoparticles for the delivery of pharmaceuticals wherein such nanoparticles comprises silk fibroin, chitosan and a drug or nutraceutical.

Zhang Y. Q., ET AL., Journal of Nanoparticle Research, 9:885-900, 2007, refer to methods for preparing fibroin nanoparticles.

DE 10040564 discloses an aqueous composition comprising chitosan and an acid agent to treat aged textiles.

CN 101619540 discloses the treatment of aged textiles with fibroin.

Technical Problem

Preserving historical textiles should take into account several critical points, such as the variety of materials, states of degradation and the history of conservation every material have been subjected to.

Conservation and preservation of historical textiles should avoid the integration, chosen only where the legibility of the work is strongly compromised, look at a "crystallization" of the state of deterioration of artwork, avoiding or delaying its progress, stop the degradation process, removing the harmful elements or minimizing their effect, preferably without sacrifice parts of the work. The methods for conserving, restoring, removing, repairing and preserving historical textiles known in the art present several drawbacks: the use adhesive and consolidation polymers imply the risk of pulverization and heavy decay especially of archaeological fragile textiles. In fact, polymers are strongly invasive since they strongly bind to the textiles, promoting harm for the artworks, such as stiffness, yellowing and color differences. Then, these polymers are also difficult to be removed and require the application of organic solvents even under extreme conditions, including high temperature, which are extremely harmful to the textile. Several works present the use of bacteria for consolidation, but their use imposes strict conditions in culture growth, and their incomplete removal, after the consolidation action, or the use of improper bacteria can bring further decay of textiles. Fibroin is not able to create any bond with the fibers and the use of cross-linking agents, as EDGE or glutaraldehyde solution, can cause corrosion or toxicity. Chitosan can increase the stiffness of yarns without improving mechanical properties of the textiles, can cause color change and does not allow consolidated threads to be subjected to humidification and flattening actions.

Therefore, the inventors of the present invention, in view of the unsatisfactory results present in the in the prior art, investigated new solutions to be used for the treatment of historical textiles. They unexpectedly found that fibroin nanoparticles in combination with chitosan and/or chitosan derivatives are able to interact positively together and have a synergic activity in conservation of finishing the textile manufactures; thus solving the technical problem posed by the prior art.

OBJECT OF THE INVENTION

Therefore, with reference to the attached claims and the following detailed description, the above technical problem is solved by an aqueous composition comprising chitosan and fibroin nanoparticles and an acid agent wherein the aqueous composition has a pH equal or lower than 6, wherein the aqueous composition has a viscosity equal or lower than 3.5 $kg \times m^{-1} \times s^{-1}$, measured at 25.0±0.1° C.; wherein fibroin nanoparticles have a diameter equal or lower than 140 nm.

A further object of the present invention is a method for the preparation of the above aqueous composition comprising the following steps:

a) adding chitosan to water under stirring and in the presence of an acid agent, to obtain an aqueous solution, then b) adding fibroin nanoparticles to obtain the aqueous composition.

Another object of the invention is the use of above aqueous composition as finishing agent and/or preservation agent and/or restoration agent and/or renovation agent and/or repairing agent and/or consolidation agent to be used in the finishing and/or preservation and/or restoration and/or renovation and/or repairing and/or consolidation of manufactures.

Another object of the present invention is a kit for the sequential or combined use of the ingredients comprised in the above aqueous composition comprising chitosan an acid agent in an amount to obtain a pH equal or lower than 6, wherein fibroin nanoparticles have diameter equal or lower than 140 nm, wherein the final aqueous composition has a viscosity equal or lower than 3.5 $kg \times m^{-1} \times s^{-1}$ measured at 25.0±0.1° C.

Another object of the present invention is a process for finishing and/or preservation and/or restoration and/or renovation and/or repairing and/or consolidation of manufactures, preferably antique manufactures, by applying to the manufacture to be treated the above aqueous composition. Further features of the invention will be clear from the following detailed description with reference to the attached figure and to the experimental data and the non limitative examples.

DETAILED DESCRIPTION OF THE INVENTION

Definitions

Figure 1:
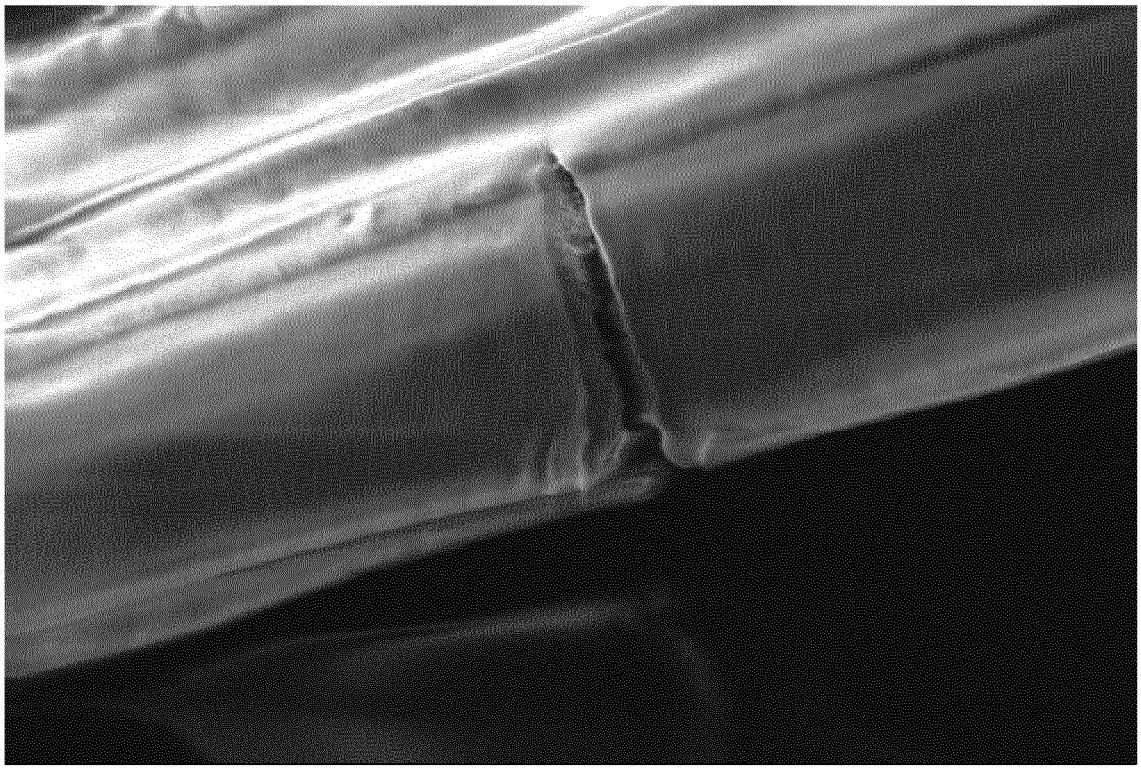
FIG. 1 reports an image obtained by fluorescence microscopy (EHT=5.00, Signal A=SE2, WD=7.2 mm, Mag=20.00 KX, scale 2 μm), showing a facture in a fiber, treated with fibroin nanoparticles solution alone.

Within the meaning of the present invention, manufacture means textiles and/or paper.

Within the meaning of the present invention, textiles are textiles with protein composition and/or textiles with cellulosic composition.

Within the meaning of the present invention textiles can be made also of synthetic fibers such as polyester or natural fibers such as wool, cotton, hemp, linen and mixture thereof.

Within the meaning of the present invention, paper can have a cellulosic composition or protein origin, such as in parchment.

Within the meaning of the present invention, ancient textiles are manufactures damaged by photo-degradation processes and/or mechanical stress and/or biological attacks.

Within the meaning of the present invention, chitosan means a linear polysaccharide composed of randomly distributed β-(1→4)-linked D-glucosamine and N-acetyl-D-glucosamine.

Within the meaning of the present invention, chitosan means chitosan, chitosan derivatives, modified chitosan and chitosan salts.

Within the meaning of the present invention salts of chitosan may be nitrate, phosphate, sulfate, hydrochloride, glutamate, lactate or acetate salts.

Within the meaning of the present invention, chitosan derivatives are chitosan ester, chitosan ether, chitosan derivatives formed by bonding of acyl and/or alkyl groups with —OH groups, but not the $NH_2$ groups, of chitosan, such as O-alkyl ethers of chitosan and O-acyl esters of chitosan.

Within the meaning of the present invention, modified chitosan may be chitosan conjugated to polyethylene glycol.

Examples of chitosan, chitosan derivatives, modified chitosan and chitosan salts, within the meaning of the present invention are disclosed in US20110305765, therefore the cited parts are incorporated herein by reference.

Chitosans of different molecular weights can be prepared by enzymatic degradation of high molecular weight chitosan using chitosanase or by the addition of nitrous acid, by process well known to the person skilled in the art, (Allan et al., Carbohydr Res. 1995 Nov. 22; 277(2):257-72 Domard et al., Int J Biol Macromol. 1989 October; 11(5):297-302. IDEM). The chitosan is water-soluble and may be produced from chitin by deacetylation to a degree of greater than 40%, preferably between 50% and 98%, and more preferably between 70% and 90%.

Within the meaning of the present invention, fibroin means fibroin and fibroin derivatives.

Within the meaning of the present invention, fibroin means the insoluble protein present in silk, which is produced by spiders, the larvae of *Bombyx mori*, other moth genera such as *Antheraea, Cricula, Samia* and *Gonometa*, and other insects as disclosed in US2011/0305765 and in Garside P. et al., Applied Physics A, 89:871-876, 2007., for example genetically engineered fibroin, chemically synthesized fibroin, or fibroin obtained from natural sources, fibroin produced from genetically engineered cells in vivo or in vitro.

Within the meaning of the present invention, fibroin derivatives may be partial sequences of full-length fibroin, maybe partial sequences of full-length fibroin including One or more additional amino acid residues at the C-terminus or N-terminus, fibroin derivatives may be polypeptide with at least 50%, 52%, 54%, 56%, 58%, 60%, 62%, 64%, 66%, 68%, 70%, 72%, 74%, 76%, 78%, 80%, 82%, 84%, 86%, 88%, 90%, 92%, 94%, 96%, 98%, 99% or greater sequence homology to a known fibroin protein.

The object of the present invention is an aqueous composition comprising chitosan and fibroin nanoparticles and an acid agent wherein the aqueous composition has a pH equal or lower than 6, wherein the aqueous composition has a viscosity equal or lower than 3.5 $kg \times m^{-1} \times s^{-1}$ measured at 25.0±0.1° C.; wherein fibroin nanoparticles a diameter equal or lower than 140 nm.

Another object of the invention is the use of above aqueous composition as finishing agent and/or preservation agent and/or restoration agent and/or renovation agent and/or repairing agent and/or consolidation agent to be used in the finishing and/or preservation and/or restoration and/or renovation and/or repairing and/or consolidation of manufactures.

Another object of the present invention is a kit for the sequential and/or combined use of the ingredients comprised in the aqueous composition comprising chitosan an acid agent in an amount to obtain a pH equal or lower than 6, wherein fibroin nanoparticles have a diameter equal or lower than 140 nm, wherein the final aqueous composition has a viscosity equal or lower than 3.5 $kg \times m^{-1} \times s^{-1}$ measured at 25.0±0.1° C.

A further object of the present invention is a method for the preparation of an aqueous composition comprising chitosan and fibroin nanoparticles and an acid agent wherein the aqueous composition has a pH equal or lower than 6, wherein the aqueous composition has a viscosity equal or lower than 3.5 $kg \times m^{-1} \times s^{-1}$ measured at 25.0±0.1° C.; wherein fibroin nanoparticles a diameter equal or lower than 140 nm, by adding chitosan to water under stirring and in the presence of the acid agent to obtain the pH equal or lower than 6, followed by the addition of fibroin nanoparticles.

Another object of the present invention is a process for finishing and/or preservation and/or restoration and/or renovation and/or repairing and/or consolidation of manufactures, preferably antique manufactures, by applying to the manufacture to be treated the aqueous composition comprising chitosan and fibroin nanoparticles and an acid agent wherein the aqueous composition has a pH equal or lower than 6, wherein the aqueous composition has a viscosity equal or lower than 3.5 $kg \times m^{-1} \times s^{-1}$ measured at 25.0±0.1° C.; wherein fibroin nanoparticles a diameter equal or lower than 140 nm.

Preferably chitosan is in a concentration not higher than 2% W of the total weight of the aqueous composition.

Preferably chitosan is in in a concentration between 1.0 and 2.0% W of the total weight of the solution.

Preferably chitosan is selected from the group consisting of chitosan, chitosan derivatives, modified chitosan and chitosan salts or a mixture thereof.

Preferably chitosan salts are selected from the group consisting of: chitosan nitrate, chitosan phosphate, chitosan sulfate, chitosan hydrochloride, chitosan glutamate, chitosan lactate or chitosan acetate or a mixture thereof.

Preferably chitosan derivatives are selected from the group consisting of: chitosan ester, chitosan ether, O-alkyl ethers of chitosan or O-acyl esters of chitosan or a mixture thereof.

Preferably modified chitosan is chitosan conjugated to polyethylene glycol.

Preferably chitosan has a molecular weight not lower than 4,000 Dalton, more preferably chitosan has a molecular weight ranging from 25,000 to 2,000,000 Dalton, even more preferably chitosan has a molecular weight ranging from 50,000 to 300,000 Dalton, most preferably chitosan has a molecular weight between 50,000-190,000 Dalton.

Fibroin is selected from the group consisting of: fibroin, fibroin derivatives or a mixture thereof.

Preferably fibroin is selected from the group consisting of: fibroin from silk produced by spiders, fibroin from silk produced by the larvae of Bombyxmori, fibroin from silk produced by moth genera *Antheraea*, fibroin from silk produced by moth genera *Cricula*, fibroin from silk produced by moth genera *Samiaor* fibroin from silk produced by moth genera *Gonometa*, genetically engineered fibroin, chemically synthesized fibroin or a mixture thereof Preferably fibroin derivatives are selected from the group consisting of be partial sequences of full-length fibroin, partial sequences of full-length fibroin including one or more additional amino acid residues at the C-terminus or N-terminus, fibroin polypeptide with at least 50%, 52%, 54%, 56%, 58%, 60%, 62%, 64%, 66%, 68%, 70%, 72%, 74%, 76%, 78%, 80%, 82%, 84%, 86%, 88%, 90%, 92%, 94%, 96%, 98%, 99% or greater sequence homology to a known fibroin protein or a mixture thereof.

Preferably fibroin nanoparticles have a diameter comprised between 20-140 nm.

Preferably the pH is between 4 and 6, more preferably between 4 and 5.5.

The acid may be any acid agent to obtain a pH equal or lower than 6, preferably the acid is an organic acid and/or an inorganic acid, more preferably the acid is selected from the group consisting of hydrochloric acid, sulfuric acid, formic acid and acetic acid and mixtures thereof and most preferably the acid is acetic acid.

Preferably the aqueous composition has a viscosity comprised between 2.5 $kg \times m^{-1} \times s^{-1}$ and 3.5 $kg \times m^{-1} \times s^{-1}$, more preferably between 2.5 $kg \times m^{-1} \times s^{-1}$ and 3.1 $kg \times m^{-1} \times s^{-1}$, most preferably the aqueous composition has a viscosity of 2.850 $kg \times m^{-1} \times s^{-1}$.

Viscosity is measured at 25.0±0.1° C.

The final viscosity of the solution is measured at 25.0±0.1° C. using Schoot Gerate AVS 440, an Ubbelohde suspended-level capillary automatic viscometer (U-tube viscometer), which allowed to determine kinematic viscosity by measuring the time it took for the sample, whose volume is defined by two ring-shaped marks, to flow laminarly through a capillary under the influence of gravity.

Preferably the aqueous composition is applied to the manufacture to be treated by immersion, dipping, brushing or spraying.

Preferably manufacture is textiles and/or paper.

Preferably textiles are textiles with protein composition and/or textiles with cellulosic composition.

Preferably textiles made of synthetic fibers are of polyester.

Preferably textiles made of natural fibers are textiles of wool, textiles of cotton, textiles of hemp, textiles of linen and/or textiles of mixture thereof.

Preferably textiles are made of mixtures of natural and synthetic fibers.

Preferably paper is paper with cellulosic composition or paper with protein origin.

Preferably, ancient textiles are flags, clothes, furnishing fabrics, tapestries, canvases, lining fabrics, mummies bands and suits.

Preferably, ancient papers are cellulosic pages from ancient books or manuscripts and from parchment.

The advantages of the liquid composition or the application of liquid composition are the improvement of mechanical properties, such as the tensile strength and the elasticity imposed to the manufactures. The treated manufacture, for example aged silk, recover the elasticity, and the tensile test curves show in FIG. 2 an elasticity trend similar to not aged silk. Furthermore, the application of liquid composition improve the resistance to UVB aging, UV aging and temperature aging.

Furthermore, another advantage of the liquid composition is its reversibility. In fact, it needs to be applied again, in the long term. This aspect indicates a minor invasive features of the consolidation treatment if compared to the synthetic polymers used traditionally, which, during the time and when aged, constitute another damage for fibers and would not be potential be removed without increasing damages to the treated fibers.

In a preferred embodiment of the present invention the aqueous composition comprises chitosan at a concentration of 1.0% W of the total weight of the aqueous composition fibroin nanoparticles at a concentration of 0.2% W of the total weight of the aqueous composition and acetic acid wherein the aqueous composition has a pH between 4 and 5.5, wherein the aqueous composition has a viscosity of 2.850 $kg \times m^{-1} \times s^{-1}$ measured at 25.0±0.1° C., wherein fibroin nanoparticles have a diameter comprised between 20-140 nm equal or lower than and a diameter equal or lower than 140 nm.

In a preferred embodiment the kit for the sequential and/or combined use of the ingredients comprised in the aqueous composition comprising chitosan in an amount to obtain a concentration preferably not higher than 2% W of the total weight of the final aqueous composition, an acid agent in an amount to obtain a pH equal or lower than 6, wherein fibroin nanoparticles have a diameter equal or lower than 140 nm, wherein the final aqueous composition has a viscosity equal or lower than 3.5 $kg \times m^{-1} \times s^{-1}$ measured at 25.0±0.1° C. comprises chitosan and fibroin nanoparticles in the form of powder and an aqueous solution comprising the acid agent which are in a pre-measured and packaged units, together with devices to prepare and apply the aqueous composition and instructions of use.

In a preferred embodiment the aqueous composition is applied to the manufacture to be treated by dipping, the composition is left acting on the manufactures for a period of time ranging from 6 to 36 hours, preferably for a period of time ranging from 18 to 30 hours, most preferably for a period of time of 24 hours.

In a preferred embodiment the aqueous composition is applied to the manufacture to be treated by brushing, the composition is applied from one to five times, preferably the composition is applied one time, most preferably the composition is applied three times.

In a preferred embodiment the aqueous composition is applied to the manufacture to be treated by spraying the composition is applied from 1 to three times, preferably the composition is applied three time, most preferably the composition is applied two times.

The following examples are given to illustrate the invention and are not to be considered as limiting the corresponding scopes.

EXAMPLES

Example 1—Preparation of the Liquid Composition

Preparation of Fibroin Solutions

The preparation of fibroin solution followed the protocol described in Zhang Y. Q., et al., Journal of Nanoparticle Research, 9:885-900, 2007.

1.39 g of silk hank was degummed twice in boiling solution of 0.5% $Na_2CO_3$ for 0.5 hours, and the resulting degummed fiber was subsequently introduced in 150 mL of a dissolving solution of calcium chloride, ethanol and water ($CaCl_2$:$C_2H_5OH$:$H_2O$, 1:2:8 mole ratio) at 90° C. for 2 hours. Then, the silk fibroin-salts solution was centrifuged at 8000 rpm for 10 minutes and the solution or supernatant was dialyzed for 48 hours against running pure water to remove $CaCl_2$, smaller molecules and some impurities using a cellulose semi-permeable membrane. The aqueous solution of silk fibroin was lyophilized. The fibroin solution was obtained solubilizing the lyophilized powder in water to obtain a solution of 2% by weight.

Preparation of Fibroin Nanoparticles

The lyophilized powder prepared previously was solubilized in water to obtain a solution of 5.0% by weight. After that, it was rapidly introduced into at least 72% (V/V) of the final mixture volume of water-miscible organic solvent by using a sample pipette at room temperature. In this case, the organic solvent was acetone. The SFNs suspended in the mixture comprising water and organic solvent were water-insoluble and went down slowly due to nanoparticles gathering. The solution was left under magnetic stirring for 12 hours. The silk fibroin nanoparticles (SNFs) precipitates were collected and purified from the mixture by repeated centrifugation at 12,000 rpm. After the supersonic treatment (with a J.P.-Selecta S.p.a supersonic bath) for 2 minutes, the solution was lyophilizes again, obtained a powder of SFNs of around 400 mg. The resulting lyophilized SFNs were used for all experiments.

The SFNs appeared as a white fine powder, composed by nanoparticles, whose dimensions ranged between 20 and 40 nm, as attested by AFM measurements (The atomic force images were taken using tapping mode on a Multimode Nano-Scope IIIa (Digital Instruments/Veeco Metrology) instrument using RTSEP AFM probes, in silicon with antimony, with a tip of 8 μm (radius). The resonant frequency used is 300 kHz and a 40 N/m spring constant).

Preparation of Chitosan Solutions

Chitosan solution is prepared as follows: 1 g of chitosan (from Sigma-Aldrich, purchased as a fine powder, at low molecular weight—50,000-190,000 Da—) was added to 99 g deionized water to a final weight of 100 g. This solution was stirred for 30 minutes and the 0.25 mL of $CH_3COOH$ was added to improve the solubility of chitosan in water. A solution of chitosan 1% was obtained. With the same procedures, the solutions at 2% and 0.5% were obtained.

Preparation of SNFs-Chitosan Compositions

SNFs-Chitosan composition is preferably prepared as followed: 0.2 g of SNFs are weighted and then chitosan solution at 1% is added, reaching the weight of 10 g. then, the solution is shaken and/or stirred. The final viscosity of the solution is 2.850 $kg \times m^{-1} \times s^{-1}$ measured at 25.0±0.1° C. Viscosity measurements were carried out using Schoot Gerate AVS 440, an Ubbelohde suspended-level capillary automatic viscometer, which allowed to determine kinematic viscosity by measuring the time it took for the sample, whose volume is defined by two ring-shaped marks, to flow laminarly through a capillary under the influence of gravity. The capillary was immersed in a thermostated water bath at 20.0±0.1° C.). The final pH is in the 5-5.5.

Example 2—Preparation of Different SNFs-Chitosan Liquid Compositions

The different compositions used have the following concentrations, listed in table 1:

TABLE 1

| Sample reference | Compositions employed | Concentration (% w/% w) |
|---|---|---|
| (1)* | Chitosan | 2 |
| (2)* | Chitosan | 1 |
| (3)* | Chitosan | 0.5 |
| (4)* | SNFs | 0.2 |
| (5) | Chitosan:SNFs, | 2:0.2 |
| (6) | Chitosan:SNFs, | 1:0.2 |
| (7) | Chitosan:SNFs | 1:0.1 |
| (8) | Chitosan:SNFs | 0.5:0.1 |
| (9)* | FIBROIN | 2 |

In table 1 the single asterisk indicates the comparison tests.

Example 3—Application of Different Liquid Compositions

Preparation of Artificially Aged Silk Specimens

A commercial silk aged was aged, useful to test the effectiveness of consolidating treatment. The ageing experiments have been performed with a fit-for-use ageing device, composed by four fixed UVB lamps, under a controlled atmosphere. The illuminance conditions were: illuminance 273 lux, irradiance 2.18 W/m2, component in UVA 165 W/m2, UVB 233 W/m2, UVC 7.95 W/m2. The environment was kept at 27° C. and 44% RH (average value). For the monitoring of ageing effects on silk, it has been established seven different progressive step of ageing. For every step of ageing, almost three samples of silk have been considered. Starting from the silk not treated, considered as sample 0, the samples have been collected following the scheme described in Table 2. On each sample, SEM and tensile tests have been performed.

SEM micrographs were acquired on a Zeiss UltraPlus FEG-SEM, working with a secondary electrons detector, setting EHT to 10.00 kV and WD to 4-5 mm. The samples were previously sputtered with 10 nm of Chromium. The SEM micrographs showed that not aged silk specimens were characterized by a continuous texture, homogeneous, without cracking. The examination of the aged samples revealed instead a high degree of alteration in several parts of the fabric; the fibers in fact showed cracks and lacerations. The sample texture appeared quite inhomogeneous.

This state of deterioration is reflected by a significant loss in mechanical properties, as revealed by tensile tests results, shown in table 2. Tensile tests were performed by means of DMA Q800 instrument (TA Instruments). The analyses were carried out under a stress ramp of 1 N/mm$^2$ min-1 at 26.0±0.5° C. We determined the values of the elastic modulus (E) as a function of the elongation and the tensile strength, defined as the tensile stress at which the material undergoes to fractures (or). The reproducibility was checked by repeating the experiment three times.

It is worth to note, in fact, that ultimate tensile strength decreased dramatically during the aging process, starting from a value of 46.18 N/mm2 for the not aged sample, until a value of 4.24 N/mm2 at the end of aging. Similar considerations can be made for the elongation, which decreases from a value of 92.74% to 38.20%.

TABLE 2

| Sample name | Ultimate tensile strength (N/mm$^2$) | Maximun elongation (%) | Emod (N/mm$^2$) | Strain Energy (J/m$^3$) |
|---|---|---|---|---|
| NOT aged silk specimen | 46.18 | 92.74 | 196.72 | — |
| (A.S.S.)* | 11.43 | 5.41 | 51.12 | 22.45 |

In table 2 the single asterisk indicates Aged Silk Specimen.

Then, the artificially aged silk, characterized by specific mechanical properties, were cut to obtained specimens of 2×4 cm. The different composition were applied on the artificially aged silk as follows:

By immersion in the compositions listed in table 1, for 24 hours.

By brushing: the different compositions were applied by brush, with a single application of the solutions or twice applications, allowing the tests to dry between one application and the next, or three applications, allowing the tests to dry between one application and the next. The applications did not show any significant difference, in the mechanical properties, among them.

By spraying: the different compositions were vaporized through a nebulizer.

Preparation of SNFs solution, labelled with FITC

Following the protocol described by the company which sold FITC (Sigma Aldrich), 5 mg of FITC were dissolved in 5 mL of carbonate/bicarbonate buffer 100 mM (pH=9). The solution was left under magnetic stirring for 20 min. 1 mL of FITC solution thus prepared was added to a flask containing 12 mg of SFNs, suspended in 5 mL of buffer. The solution was then left under magnetic stirring for 2 hours, at room temperature. After 2 hours, the solution was centrifuged 4 times at 3000 rpm for 20 minutes each. Finally, the solution was dialyzed for 12 hours. At the end of dialysis, the nanoparticles marked with FITC were used for the conservative experiments.

A consolidation treatment with SNFs solution, labelled with FITC, was performed. For all the experiments described, the aged silk specimens of the previous section were employed. The aged silk specimens were dipped in a 0.2% aqueous solution of SNFs-FITC. The specimens were left immersed into the solution for 24 hours, and then removed and left to dry. After the consolidation treatment, when the silk was dried, the treated sample has been analyzed by fluorescence microscopy. A Nikon Eclypse TE300 fluorescence microscopy has been used for analysis of SFNs particle consolidation textile. The microscopy was equipped with laser source. Silk fibers showed a very low intrinsic fluorescence, due to their chemical compositions, which does not interfere with the observation of SFNs. The SFNs were observed mainly into the micro-fractures and cracks of silk fibers, while their presence on not damaged fibers has been not revealed.

The results suggested that the interaction, occurred between the nanomaterials and the aged silk, would be only mechanical, SFNs remain fixed on the yarns thanks to the rough surface offered by the fractures, but no chemical interactions, such as covalent bonds, occurred.

The above results were partially confirmed by FEG-SEM micrographs.

Micrographs, referred to SFNs consolidation treatment, showed that SNFs were distributed randomly on the fibers surface, taking advantage of natural occurring roughness, due to the degradation of silk yarns. However, in FIG. 1, it was possible to appreciate a somewhat activity of bridges forming, repairing only partially the cracks between two adjacent yarns, starting from a rough surface.

Figure 2:
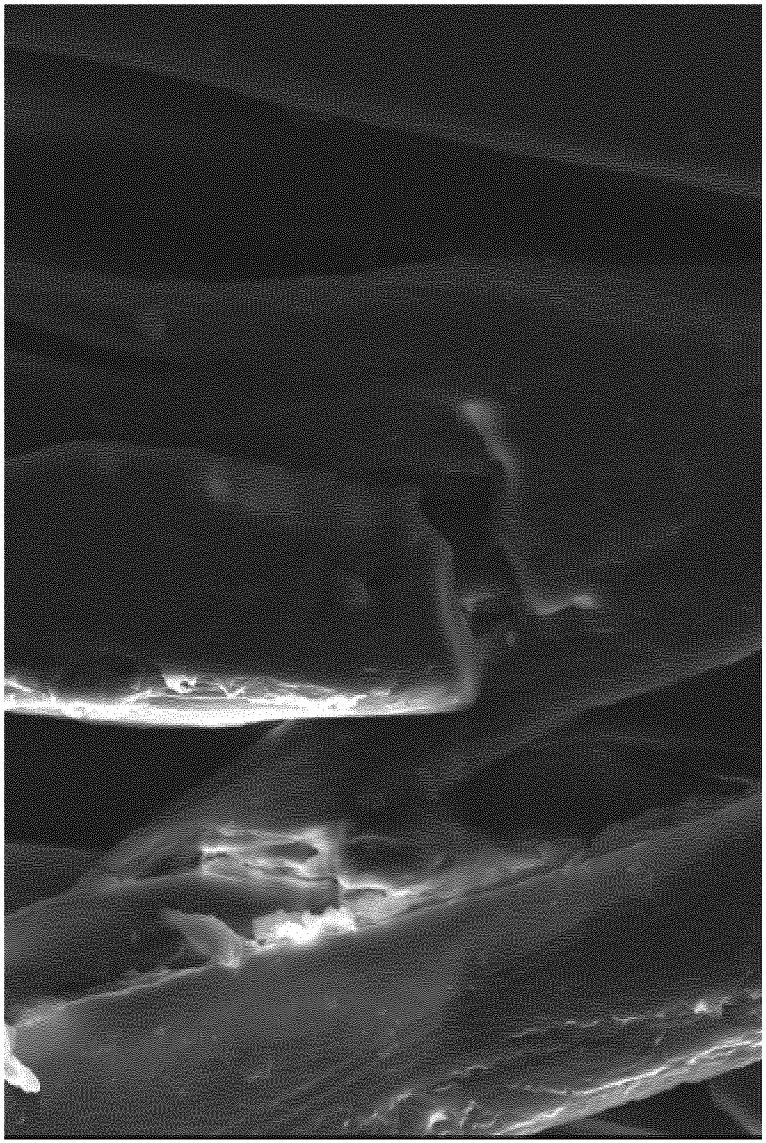
FIG. 2 reports an image obtained by fluorescence microscopy (EHT=10.00, Signal A=SE2, WD=4.4 mm, Mag=5.00 KX, scale 2 μm), showing a facture in a fiber, treated with chitosan solution alone.

Chitosan treatment creating a fiber coating, on the surface of the material, but it is not able to repair fractures and cracking, which are still visible, after the consolidation treatment, as shown in FIG. 2.

Figure 3:
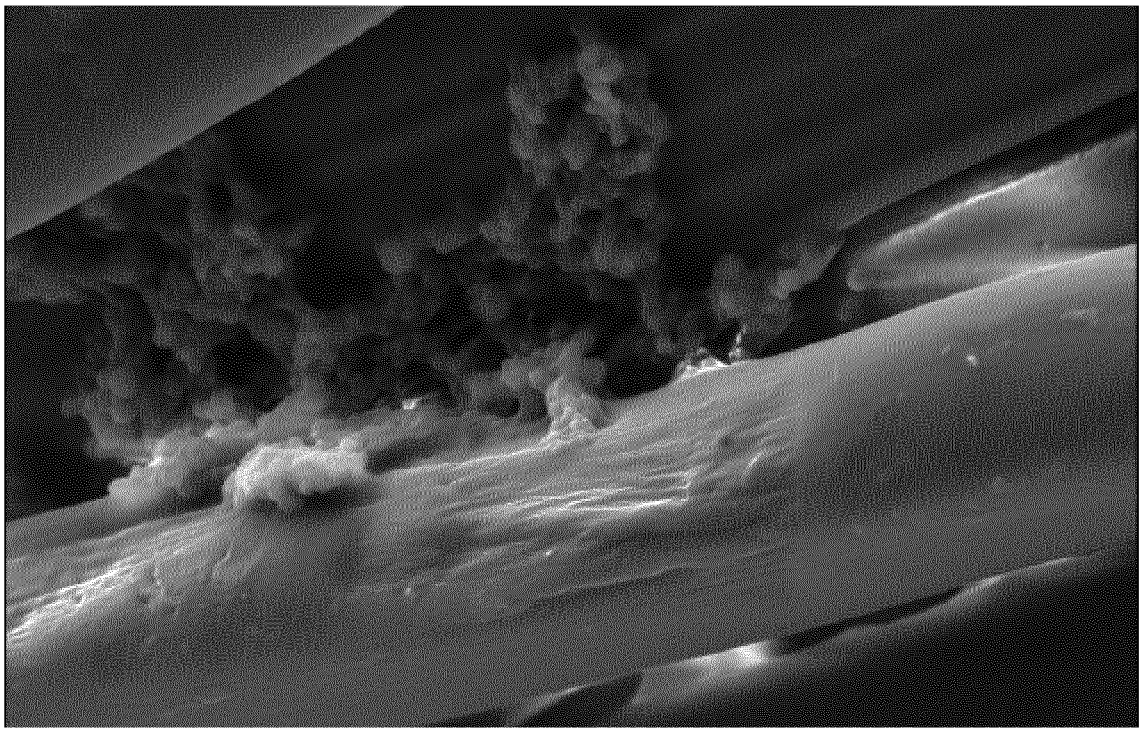
FIG. 3 reports an image obtained by fluorescence microscopy (EHT=10.00, Signal A=SE2, WD=4.4 mm, Mag=5.00 KX, scale 1 μm), showing a fracture in a fiber treated with the composition chitosan/fibroin.

Observing the interaction between chitosan and nanofibroin, it is worth to notice that they are capable of getting together to form branched structures, which acts as bridges, where the nanoparticles are embedded in the carbohydrate matrix. At the same time, it is possible to observe the presence of individual fiber coating. Overall, this complex structure reveals to be extremely flexible and totally repaired the fractures, which are not more visible, as shown in FIG. 3.

Example 4—Evaluation of the Effectiveness of Consolidation Treatment

The effectiveness of the treatments was evaluated firstly through tensile and the results are reported in Table 3.

TABLE 3

| Sample name (Concentration is espressed in % w/% w) | Ultimate tensile strength (N/mm$^2$) | Maximun elongation (%) | Emod (N/mm$^2$) | Strain Energy (J/m$^3$) |
|---|---|---|---|---|
| A.S.S.** | 11.43 | 5.41 | 51.12 | 22.45 |
| (2)* | 18.79 | 6.02 | 441.9 | 55.48 |
| (4)* | 9.51 | 5.49 | 47.43 | 19.44 |
| (5) | 20.50 | 7.66 | 454.40 | 80.17 |
| (6) | 20.48 | 6.76 | 469.00 | 77.13 |
| (9)* | 5.90 | 3.39 | 294.5 | 19.70 |

In table 3 the double asterisk indicates A.S.S. (Aged Silk Specimens), the single asterisk indicates comparison tests.

Comparing with not treated silk specimen, chitosan-SNFs always improves the mechanical properties, allowing the silk specimen to tolerate at least a doubled stress.

Figure 4:
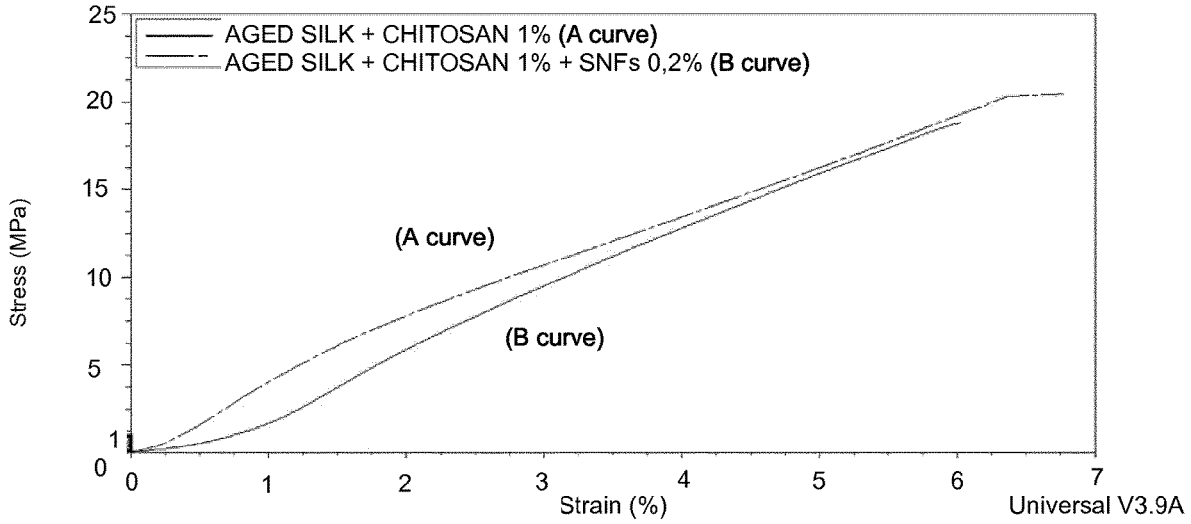
FIG. 4 shows tensile test graphs, in which the tensile curves of treated fibers are presented.

Besides, as clearly shown by the tensile curves of FIG. 4 chitosan-SFNs composition mainly improves the mechanical properties. In particular, not only the ultimate tensile strength is strongly improved, but also the Young's Modulus is increased from 51 N/mm2 to 469 N/mm2. Furthermore, it is worth of notice that the shape of the first part of this curve (Chitosan:SNFs, 1:0.2, curve A), referable to the elastic properties of the material, is almost completely comparable with those referable to not aged silk present in literature [Perez-Rigueiro J., et al., Journal of Applied Polymer Science, 70:2439-2447, 1998]. The same consideration cannot be made for curve B, referable to aged silk treated with chitosan.

For the mixture chitosan-SNFs, the best ratio appeared to be the chitosan:SNFs, 1:0.2., which maximized the mechanical properties.

Measurements of Statistic Contact Angle (ϑs)

For what concerns the hydrophobic properties, measurements of statistic contact angle (ϑs) were performed on an aged silk specimen, without any treatment, and on treated samples. The measurements were performed by means of an optical contact angle apparatus (OCA 20, Data Physics Instruments) equipped with a video measuring system having a high-resolution CCD camera and a high-performance digitizing adapter. SCA 20 software (Data Physics Instruments) was used for data acquisition. The water contact angle just after deposition was measured by the sessile drop method by gently placing a droplet of 6.0±0.5 μL onto the surface of the specimen. The temperature was set at 25.0±0.1° C. for the support and the injecting syringe as well. A minimum of five droplets were examined for each specimen.

TABLE 4

| Sample name | Statistic contact angle ($\theta_s$) |
|---|---|
| AGED SILK SPECIMENS (A.S.S.) | 76.4 |
| (2)* | 108.1 |
| (6) | 95.5 |

In table 4 the single asterisk indicates comparison tests.

Hydrophobicity is a negative feature, because it prevents further washing and maintenance operations on the manufactures. A statistic contact angle of 76.4°, referable to hydrophilic surface, was measured for untreated samples. Otherwise, all samples treated with chitosan are highly hydrophobic while the treated with composition of the invention are very less hydrophobic. This means fibers can be subjected to the ordinary maintenance operations.

Colorimetric Measurements

Colorimetry measurements were carried out firstly on the aged silk specimen, not treated, and on the aged silk treated with the composition of the invention. Colorimetric measurements were performed through The Exemplar® LS, by BWTEK, composed by a CCD spectrometer optimized for low stray-light by utilizing an unfolded Czerny-Turner spectrograph. The Exemplar LS was used in the following configuration: wavelength range of 200-850 nm, 25 μm slit, an LVF filter, a ruled grating (600/250), and a spectral resolution of 1.5 nm. Each measurement has been carried out interfacing the spectrometer to an optical microscope BEL photonics, with a magnification of 100×, via optical fiber. Every measure have been carried out on 10 points and then calculate the average value.

From the colorimetric analyses, no sensible chromatic variations are appreciated on the samples treated with composition of the invention, while with chitosan yellowish.

Accelerated Ageing Experiment

The silk specimens treated with the composition of this invention were subjected to further ageing process. Further aging experiments were performed with a UV Accelerated Weathering Tester produced by Q-Lab (QUV-spray model); temperature of the chamber was set at 45° C. and irradiance was set at 0.75 W/m2 at 310 nm (maximum emission wavelength of the lamp).

The effects of aging process were evaluated through tensile tests and colorimetric measurements. The results of tensile tests are shown in the following tables 5. The specimen treated with Chitosan-SFNs mixture (1:0.2, % w/w) progressively loosed its consolidating properties, even if valuable changes occur in ten days of ageing under UVB radiation, when the ultimate tensile strength dramatically decreased to a value similar to not treated sample. The colorimetric variations reached a noticeable value of chromatic variations in ten days, as shown in table 5.

TABLE 5

| | Ultimate tensile strength ($N/mm^2$) | | Maximun elongation (%) | | Emod ($N/mm^2$) | | Strain Energy ($J/m^3$) | |
|---|---|---|---|---|---|---|---|---|
| Sample name | TREATED | NOT TREATED | TREATED | NOT TREATED | TREATED | NOT TREATED | TREATED | NOT TREATED |
| SILK | 15.30 | 6.37 | 4.89 | 6.11 | 431.50 | 38.60 | 117.16 | 20.34 |
| AFTER 2 DAYS OF ACCELERATED AGING | 11.48 | 5.17 | 3.39 | 6.06 | 267.80 | 55.80 | 65.82 | 13.40 |
| AFTER 4 DAYS OF ACCELERATED AGING | 6.14 | 5.17 | 6.04 | 6.96 | 178.60 | 62.24 | 18.87 | 8.42 |
| AFTER 10 DAYS OF ACCELERATED AGING | 3.54 | 5.17 | 4.11 | 6.39 | 119.91 | 34.73 | 7.02 | 7.08 |

The not treated samples showed obviously a slight decrease of their mechanical properties, due to their already poor tensile properties at the beginning of aging test, as shown in table 6.

The colorimetric variations were slightly appreciable; in this case, there was a minimal yellowish phenomenon, due to the increasing of pre-existing oxidation processes, as shown in table 7.

Application of Composition to Dyed Yarns

The composition was applied also to dyed yarns and they were subjected to ten days of accelerated aging under UVB radiation.

Dyed yarns with orcein dyes were prepared according to literature [Cardon D., Belin, 2014].

The results of colorimetric analyses are listed in table 6. In the table, the chromatic variations (ΔE*) for the untreated and treated samples are reported [Manhita A. et al., Analytical and Bioanalytical Chemistry, 400: 1501-1514, 2011.].

TABLE 6

| | Without Conservation Treatment | | | With Conservation Treatment | | |
|---|---|---|---|---|---|---|
| | Day 0 | Day 4 | Day 11 | Day 0 | Day 4 | Day 11 |
| Colorimetric measurements, Orcein dyed yarns | | | | | | |
| L* | 38.824 | 50.637 | 51.265 | 46.173 | 44.484 | 50.568 |
| a* | 18.718 | 17.459 | 17.202 | 26.887 | 18.738 | 17.828 |
| b* | 4.122 | 16.478 | 20.884 | −6.142 | −3.381 | 11.431 |
| Colorimetric Variations | | | | | | |
| ΔL | | 11.813 | 12.44 | | −1.689 | 4.395 |
| Δa | | −1.259 | −1.52 | | −8.149 | −9.059 |
| Δb | | 12.356 | 16.76 | | 2.761 | 17.573 |
| ΔE* | | 17.141 | 20.93 | | 8.768 | 20.253 |

In table 7 L*parameter is the brightness, wherein 0 is for black and 100 is for white; the a*parameter is the red-green component, which is positive for red and negative for green; the b*parameter is the yellow-blue component, which is positive for yellow and negative for blue.

All the yarns in ten days showed a color change, due to aging processes. However, the ΔE* observed for not consolidated samples were appreciably lower than those recorded As it was possible to see, after four days, ΔE* for treated sample showed a value of 8, while the not treated sample reached a value of 17, suggesting that for dyed yarns this consolidant mixture could ensure also a protecting effect from UV radiation. When the consolidant composition degraded, after 10 days, the photo-degradation of orcein dyes occurs.

Further experiments were also performed by applying the nanofibroin-chitosan mixture by brushing instead of dipping, as disclosed in the previous tests. The results are shown in the following table 7, wherein the mechanical properties of aged silk specimen, not treated, were compared with the samples treated with chitosan:SNFs, 1:0.2% w/% w liquid composition, applied by immersion or brushing. Furthermore, the effectiveness of brush treatment by one (sample AP1), two (sample AP2) or three (sample AP3) applications was evaluated. In AP1, the Chitosan:SFNs 1:0.2,%/% mixture was applied to the test in a single step, with a brush stencil. In AP2 the Chitosan:SFNs mixture, 1:0.2,%/% was applied on the aged silk sample in two successive steps, always with a brush stencil. In particular, after the first application, the specimen was left to dry until the second application. In AP3 the Chitosan:SFNs 1:0.2, %/% mixture was applied on the aged silk sample in three successive steps.

TABLE 7

| Sample name | Ultimate tensile strength ($N/mm^2$) | Maximum elongation (%) | Emod ($N/mm^2$) | Strain Energy ($J/m^3$) |
|---|---|---|---|---|
| AGED SILK SPECIMENS (A.S.S.) NOT TREATED | 11.43 | 5.41 | 51.12 | 22.45 |
| A.S.S. + Chit:SNFs, 1:0.2, IMMERSION (24 h) | 20.48 | 6.76 | 469.00 | 77.13 |
| A.S.S. + AP1 | 18.24 | 7.90 | 384.10 | 83.46 |
| A.S.S. + AP2 | 23.61 | 10.06 | 392.80 | 194.13 |
| A.S.S. + AP3 | 30.90 | 12.18 | 387.60 | 219.01 |

The results show that brush making not only guarantees excellent elastic performance and tensile strength, but it also seems to improve, in the case of the AP3 sample, the overall mechanical performance compared to the dipped samples.

The above results demonstrated that the synergistic action nanofibroin-chitosan was unexpectedly able to return aged textiles their lost mechanical properties strongly improving the mechanical resistance in term of ultimate tensile strength and elasticity. In particular, the elastic behavior was comparable with the not aged sample, even if the order of magnitude could be different. Furthermore, the composition improved also UV radiation resistance. The aged samples, treated with chitosan-nanofibroin, showed an extensive consolidation network that interacts with the fibers. Chitosan, due to its film-forming properties, creates a coating on each fiber and bridges between the neighboring fibers; The nanofibroin, which results incorporated in the lattice of chitosan, acts as a filler in the polysaccharide network. Taking advantage of its nanoparticle nature, nanofibroin uniformly distributes the mechanical stress, which insists on the texture, preventing stress concentration and improving, from a macroscopic point of view, the mechanical properties. Also the protective action of the nanofibroin-chitosan mixture was demonstrated on dye molecules present on the yarns. The treated samples, once artificially aged, have showed chromatic variations appreciably lower than the untreated samples.

The invention claimed is:

1. Aqueous composition comprising chitosan, fibroin nanoparticles and an acid agent wherein the aqueous composition has a pH equal to or lower than 6, wherein the aqueous composition has a viscosity equal to or lower than 3.5 $kg \times m^{-1} \times s^{-1}$ measured at 25.0±0.1° C., and wherein the fibroin nanoparticles have a diameter equal to or lower than 140 nm.

2. The aqueous composition according to claim 1, wherein the chitosan is selected from the group consisting of: chitosan, chitosan derivatives, modified chitosan, chitosan salts and mixtures thereof.

3. The aqueous composition according to claim 2, wherein the chitosan salts are selected from the group consisting of: chitosan nitrate, chitosan phosphate, chitosan sulfate, chitosan hydrochloride, chitosan glutamate, chitosan lactate, chitosan acetate and mixtures thereof.

4. The aqueous composition according to claim 2, wherein the chitosan derivatives are selected from the group consisting of: chitosan ester, chitosan ether, O-alkyl ethers of chitosan, O-acyl esters of chitosan and mixtures thereof.

5. The aqueous composition according to claim 2, wherein the modified chitosan is chitosan conjugated to polyethylene glycol.

6. The aqueous composition according to claim 1, wherein the fibroin is selected from the group consisting of: fibroin, fibroin derivatives and mixtures thereof.

7. The aqueous composition according to claim 6, wherein the fibroin is selected from the group consisting of:

fibroin from silk produced by spiders, fibroin from silk produced by the larvae of Bombyxmori, fibroin from silk produced by moth genera Antheraea, fibroin from silk produced by moth genera Cricula, fibroin from silk produced by moth genera Samia, fibroin from silk produced by moth genera Gonometa, genetically engineered fibroin, chemically synthesized fibroin and mixtures thereof.

8. The aqueous composition according to claim 6, wherein the fibroin is selected from the group consisting of: partial sequences of full-length fibroin and partial sequences of full-length fibroin including one or more additional amino acid residues at the C-terminus or N-terminus, fibroin polypeptide with at least 50% sequence homology to fibroin protein.

9. The aqueous composition according to claim 1, wherein the fibroin nanoparticles have a diameter comprised between 20-140 nm.

10. The aqueous composition according to claim 1, wherein the aqueous composition has a pH between 4 and 6.

11. Kit for the sequential, or combined or both sequential and combined use of the aqueous composition of claim 1.

12. Method for the preparation of the aqueous composition according to claim 1, comprising adding the chitosan to water under stirring and in the presence of the acid agent to obtain the pH equal to or lower than 6, followed by the addition of fibroin nanoparticles.

13. Process for at least one of: finishing; preservation; restoration; renovation; repairing; or consolidation of manufactures by applying to the manufacture to be treated the aqueous composition of claim 1.

14. The process according to claim 13, wherein the aqueous composition is applied to the manufacture to be treated by immersion, dipping, brushing or spraying.

15. The process according to claim 13, wherein the manufacture to be treated is ancient textiles, ancient paper or both ancient textiles and ancient paper.

* * * * *